US005653221A

United States Patent [19]

Luken et al.

[11] Patent Number: 5,653,221

[45] Date of Patent: Aug. 5, 1997

[54] APPLIANCE BACKSPLASH ASSEMBLY

[75] Inventors: Patrick Charles Luken; Michael Stephen Woods, both of Louisville, Ky.

[73] Assignee: General Electric Company, Louisville, Ky.

[21] Appl. No.: 585,792

[22] Filed: Jan. 16, 1996

[51] Int. Cl.[6] ..... F24C 15/20

[52] U.S. Cl. ..... 126/299 C; 126/299 R; 126/39 B

[58] Field of Search ..... 126/299 C, 214 D, 126/221, 220, 42, 39 B, 39 N; 362/154, 156, 133, 457, 458, 368

[56] References Cited

U.S. PATENT DOCUMENTS

| | | | |
|---|---|---|---|
| 2,539,840 | 1/1951 | Jones | 126/39 N |
| 2,769,440 | 11/1956 | Pearce | 126/30 BA |
| 2,866,450 | 12/1958 | Reeves | 126/39 B |

*Primary Examiner*—Larry Jones
*Attorney, Agent, or Firm*—H. Neil Houser

[57] ABSTRACT

An appliance backsplash assembly includes a cover with a face having an opening for viewing and setting a clock. Top and bottom walls extend rearward of the face. An upper rear wall projects downward from the top wall and a lower rear wall projects upward from the bottom wall. A pair of mounting clips are positioned in the backsplash on each side of the opening. Each clip has a base extending vertically along the face, with a top arm and a bottom arm extending rearward along the top and bottom walls respectively. The clock includes a housing sized to overlie the opening and overlap the clips. Threaded connectors mount the clock housing to the clips and flex the clips to cause the clip bases to firmly engage the cover face and the top and bottom arms to firmly engage the top and bottom walls. The top arms include distal ends which engage the upper rear wall and the bottom arms include distal ends received in slots in the lower rear wall.

7 Claims, 2 Drawing Sheets

APPLIANCE BACKSPLASH ASSEMBLY

BACKGROUND OF THE INVENTION

The present invention relates to backsplash assemblies of major domestic appliances, such as cooking ranges and ovens, clothes washers and dryers and dishwashers. More particularly it relates to the mounting of operative assemblies, such as clocks, timers, switch panels and so forth in such backsplashes.

It is common practice to mount various operative assemblies in backsplashes by means of welding, or by using rivets, toggle locks or other mechanical fasteners which position the operative assembly housing in a predetermined position adjacent the face of the backsplash cover. In some instances mounting tabs are formed on the cover (or a plate adjacent the cover) and the operative assembly is attached to the tabs. In other instances the operative assembly is mounted to clips which are then welded or riveted to the cover. In either event, the mounting of the operative assembly requires an excessive number of steps, which is costly in mass production operations involved in the manufacture of major domestic appliances Also, with the build-up of tolerances of the various components of the backsplash assembly, the operative assemblies are not uniformly tight against the backsplash cover. This results in a gap around the edge of the access opening for the operative assembly. Thus the operative assemblies are subject to rattling and unsightly soil tends to accumulate in the gap.

It is an object of the present invention to provide an improved appliance backsplash assembly.

It is another object of the present invention to provide such an improved assembly in which the housing of an operative assembly, such as a clock for example, is held in firm engagement with the face of the backsplash assembly despite variations in the tolerances of various components.

It is yet another object of this invention to provide such an improved assembly which is easy and low cost in manufacture.

SUMMARY OF THE INVENTION

In accordance with one form of the present invention an appliance backsplash assembly includes a cover having a face defining an opening therethrough, a top wall projecting generally rearward from the top of the face and a bottom wall projecting generally rearward from the bottom of the face. A pair of flexible clips are positioned behind the face on opposite sides of the opening. Each clip includes a base extending vertically along the face with a top arm and a bottom arm extending rearward along the top and bottom walls respectively. An operative assembly includes a housing sized to overlie the opening and to overlap the clips. A plurality of connectors mount the operative assembly housing in engagement with the clip bases and with the housing abutting the face and with the clips flexed so that the clip bases firmly engage the face and the clip top and bottom arms firmly engage the top and bottom walls respectively.

DETAILED DESCRIPTION OF PREFERRED EMBODIMENT

Figure 1:
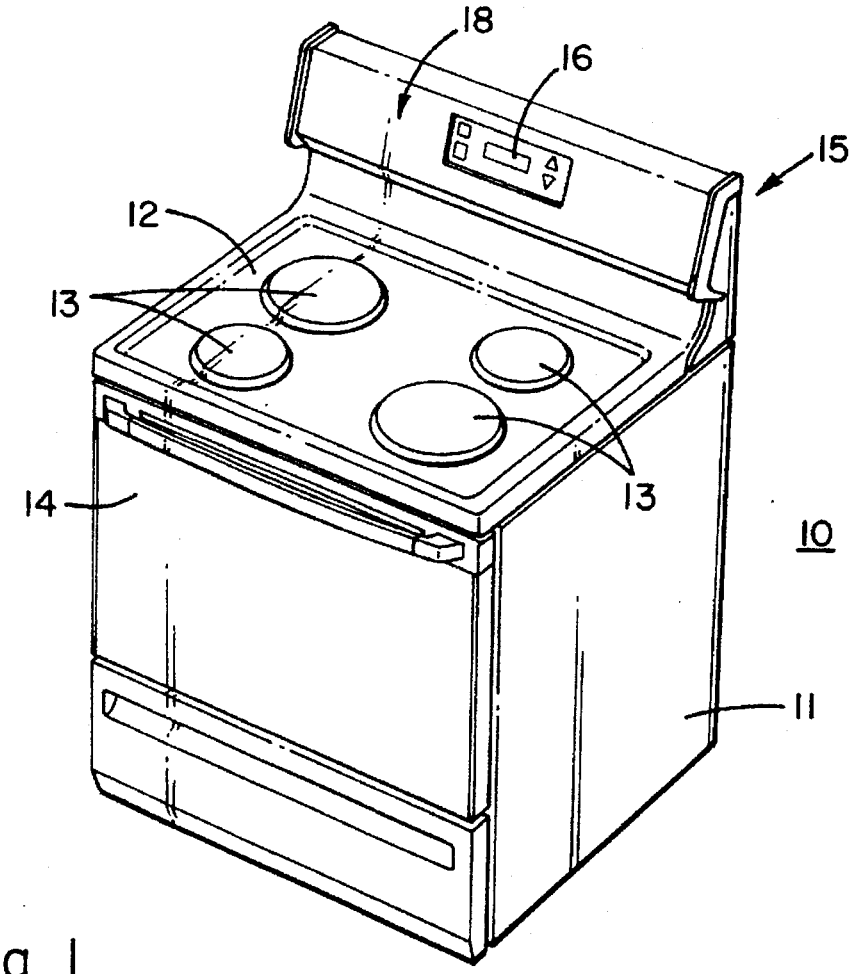
FIG. 1 is a somewhat simplified perspective view of a free-standing range, including a backsplash assembly incorporating one embodiment of the present invention.

Referring now to the drawings and particularly to FIG. 1, there is shown for illustrative purposes a free standing electric range 10 with an outer body or cabinet 11 that incorporates generally rectangular cooktop 12 having four separate surface cooking units 13. An oven, not shown, is positioned below the cooktop and has a front access door 14. A range backsplash 15 extends upward of the rear portion of the cooktop 12 and contains various controls or operative devices for both the oven and the surface units. For the sake of simplicity only a combination clock and timer 16 for the oven has been illustrated. It will be understood that in addition to clocks, the present invention is applicable to mounting assemblies for various other control or operative assemblies for ranges as well as to mounting assemblies for backsplashes of other appliances such as, for example clothes washers and dryers and dish washers.

Referring now to FIGS. 2–6, it will be seen that the backsplash assembly 15 includes a cover 18 that extends between a pair of spaced apart end caps 19. The cover includes a generally rectangular face 20 that is disposed generally vertically (in the illustrations the face tilts slightly rearward from bottom to top for better viewing by the user). The face 20 defines a generally rectangular opening 22 that provides a view of and access to the clock assembly 16. The face 20 is formed with a narrow, rearward projecting rim 23 that closely surrounds the opening 22. The cover also includes a top wall 24 that projects rearward from the top edge of the face 20, an upper rear wall 26 that projects downward from the rear edge of the top wall and an upper ledge 28 that projects forward from the lower edge of the upper rear wall 26. Thus the upper rear wall is spaced significantly to the rear of the face and the upper ledge 26 is spaced slightly below the top wall 24. In a similar manner the cover 18 also includes a bottom wall 30 that projects rearward from the bottom edge of the face 20, a lower rear wall 32.that projects upward from the rear edge of the bottom wall and an lower ledge 34 that projects rearward from the upper edge of the lower rear wall 32. Thus the lower rear wall is spaced significantly to the rear of the face 20. It will be understood that backsplashes normally have a rear panel that closes off the back of the backsplash. The rear panel has been omitted from the illustrations for the sake of simplicity.

Figure 2:
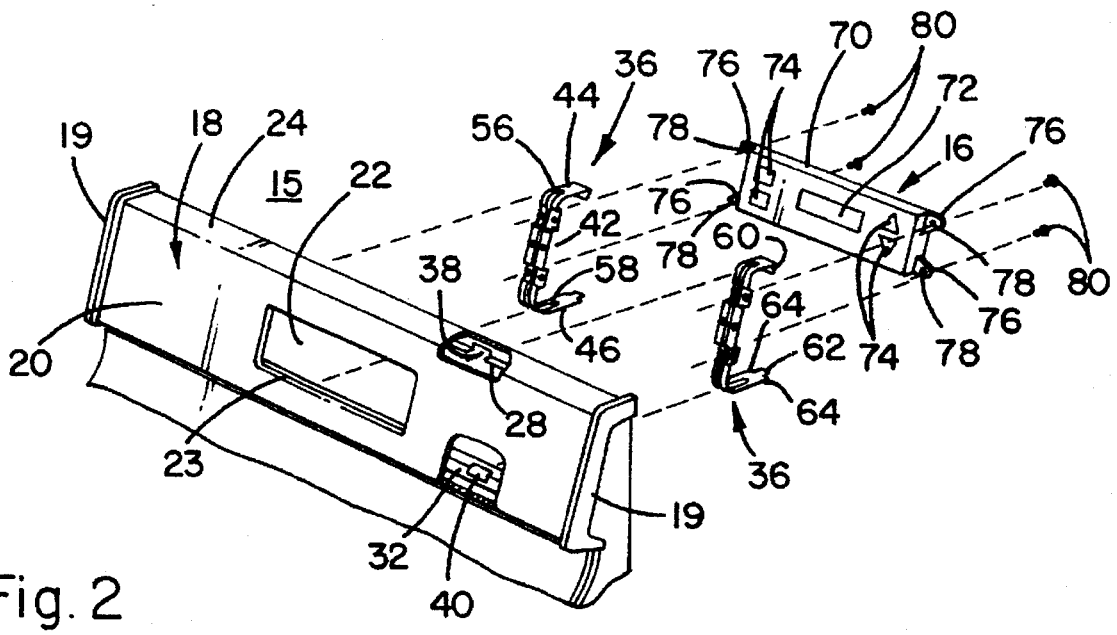
FIG. 2 is a simplified, exploded view of the backsplash assembly of FIG. 1, with the view partly broken away for illustration.
Figure 3:
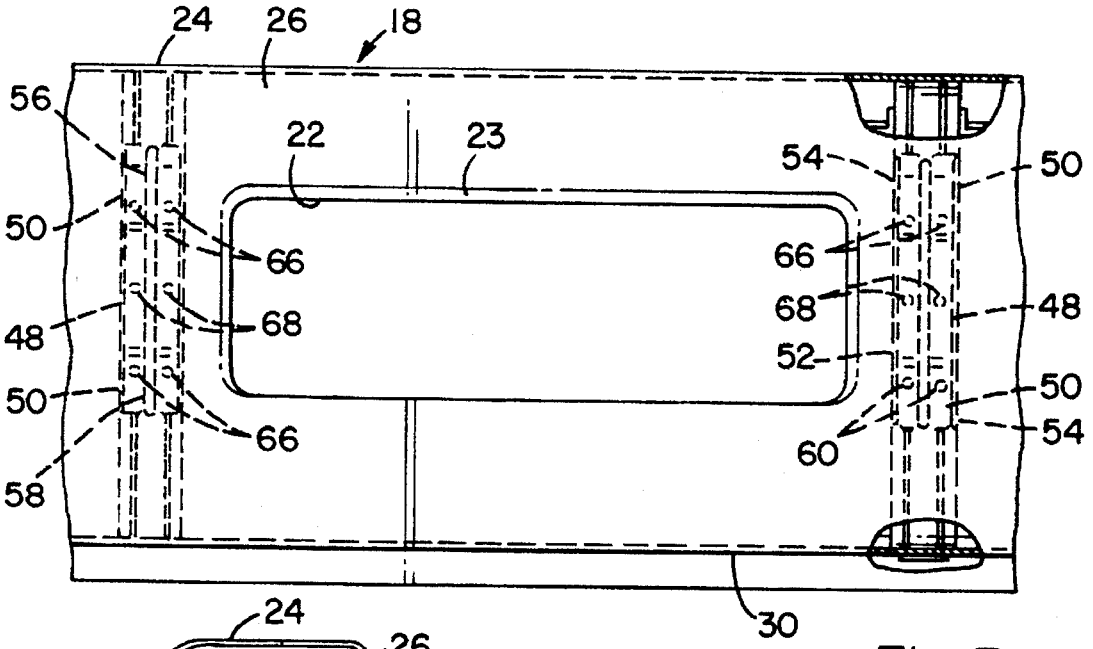
FIG. 3 is a fragmentary front elevation view of the backsplash assembly of FIG. 1, with the view partly broken away for illustration.
Figure 4:
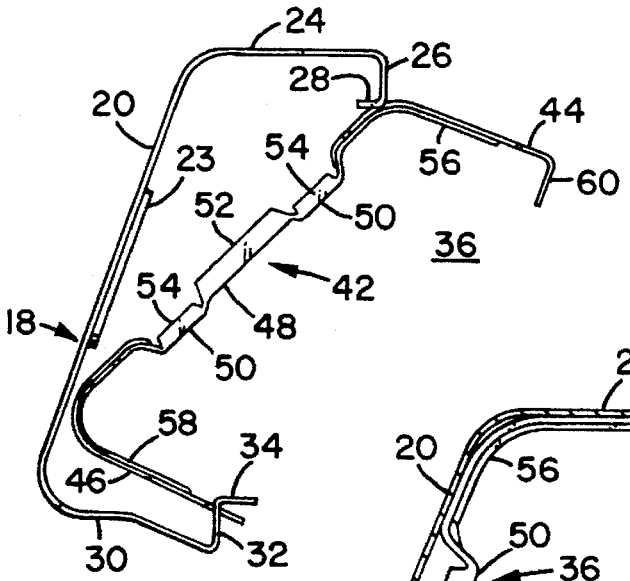
FIG. 4 is a simplified, cross-section, side elevation view of the cover of the backsplash of FIG. 1, with a mounting partially inserted into the cover.

As will be described in more detail hereafter, the clock 16 is mounted in the backsplash by means of a pair of flexible mounting clips or brackets 36 which fit against the face 20, top wall 24 and bottom wall 30. To that end the upper ledge 28 and, if desired, a small portion of upper rear wall 26 are cut away just outside the lateral edges of the opening 22. One cut away is shown at 38 in FIG. 2. A slit is provided in each lower rear wall 32 and, if desired, in a small portion of the lower ledge 34. One such slit 40 is shown in FIG. 2.

It will be understood that the clips 36 are symmetric and each clip can be used on either side of the opening 22. Each clip includes an elongated base 42 joined to a top arm 44 and a bottom arm 46. The clip is formed from a thin strip of metal, such as galvanized steel, and the junctions between the base and the top and bottom arms are smoothly curved. Thus the clip will flex and the arms move relative to the base. The base 42 includes a central section 48 positioned between and joining a pair of rearward offset sections 50. Stiffening ribs 52,54 project forward along the lateral edges of the central section 48 and offset sections 50 respectively. The stiffening ribs provide structural integrity and stiffness to the base 36. In addition stiffening ribs or indentations 56,58 can be provided along the central axis of the clip longitudinally outward from each offset portion 50 and extending into the top and bottom arms respectively. Indentations 56,58 permit the arms to flex relative to the base (up and down as seen in the drawings) while deterring twisting of the clip.

The top arm 44 has a downward projecting distal end portion or tab 60. The bottom arm has a reduced width distal end portion or tab 62 that projects rearward from a pair of shoulders 64. In order to position a clip in the cover 18 its reduced width tab 62 is inserted into one of the slits 40 and the clip is rotated thereabout until fully positioned in the cover. The aligned cutout 38 permits the top arm 44 to easily pass by the upper rear wall 26. When the clips are fully seated and the clock 16 is mounted on the clips, the tabs 60 at the end of top arms 44 rests against upper rear wall 26 and the shoulders 64 of the bottom arms rest against the lower rear wall 32 with the reduced width tabs 62 underlying the lower ledge 34.

Each of the offset base portions 50 has a pair of horizontally spaced apart openings 66 and each central section 48 has a pair of horizontally spaced apart openings 68 which are used to mount various operative assemblies, such as clock 16 for example. More specifically clock 16 includes a rectangular housing 70 sized to overlie the opening 22 and rim or flange 23 therearound. The front of the housing is formed to expose the clock face (a rectangular digital display 72 in illustrative clock 16). Control pads 74 are positioned to each side of the clock face. All of these visual items are arranged to register with the opening 22 with the front of the,housing engaging the rim or flange 23 around the opening. A tang or mounting ear 76 is formed outside each front corner of the housing 70 and each ear is provided with an opening 78 aligned with the corresponding opening 66 in the clips 36. A threaded connector, such as a screw 80, passes through each opening 78 and is threadedly received in the corresponding opening 66 to mount the clock 16 to the clips 36.

Figure 5:
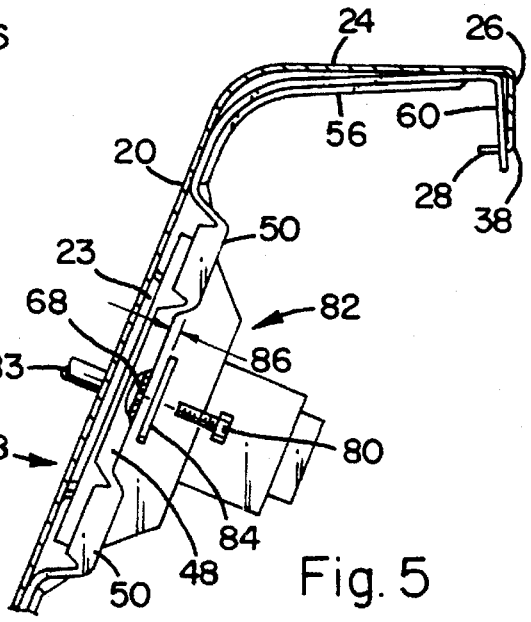
FIG. 5 is a fragmentary cross-section view of the cover of FIG. 3 illustrating the relationship of the components when an operative assembly has been inserted into the backsplash but is not fully mounted to the clips.

It may be desired to use an operative assembly, such as a clock or timer, which has only one mounting ear or tang at each end. FIG. 5 illustrates a clock 82 which has central control shaft 83 and a single mounting tang or ear 84 positioned centrally of each of its ends. Screws 80 pass through openings, not shown, in the ears 84 and are threadedly received in the openings 68 in central sections 48 of clip bases 42.

Figure 6:
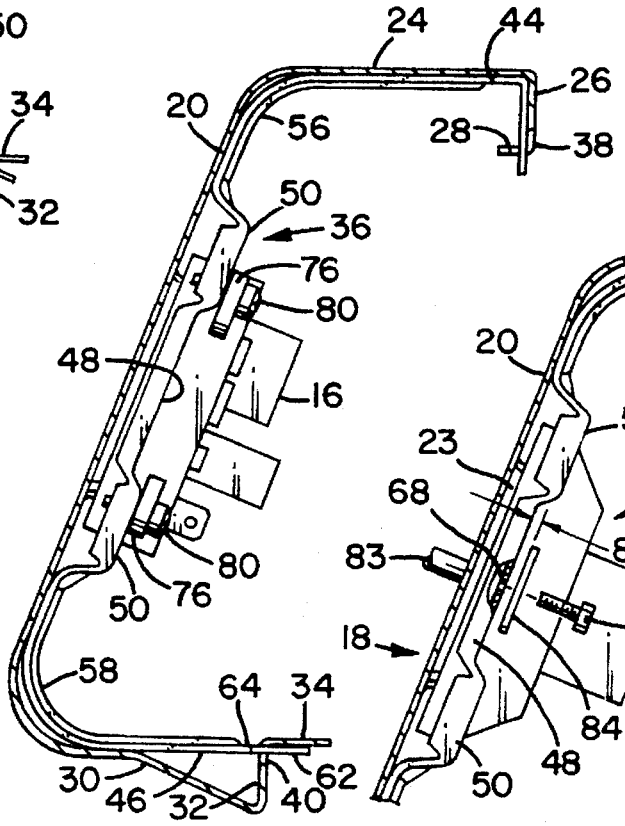
FIG. 6 is a simplified, cross-section view similar to FIG. 5, but illustrating the relationship of components when an operative assembly is fully mounted to the clips.

The mounting clips 36 are appropriately sized and proportioned relative to the operative assembly with which they are used. More particularly, with the clips positioned in the cover 18 and the front of the operative assembly resting against the rim 23 but without tightening the screws 80, there is a gap between the mounting ears and the sections of the clips which they will engage. More specifically, with clock 16 there is a gap between each ear 78 and the corresponding clip rearward offset section 50. On the other hand, with clock 82 there is a gap between each ear 84 and the corresponding clip central section 48. One such gap is illustrated at 86 in FIG. 5. However, when the screws 80 are tightened the gaps are eliminated and the ears 76,84 are drawn tightly against the corresponding sections of the mounting clips. This forces the top and bottom arms 44,46 of the clips to flex relative to the base 42. In the fully assembled configuration, as shown in FIG. 6, the bases 42 of the clips firmly engage the cover face 20, the top arms 44 of the clips firmly engage the cover top wall 24, the bottom arms 46 of the clips firmly engage the cover bottom wall 30, the distal end portions 60 of the clips firmly engage the upper rear wall 26 of the cover and the reduced width distal portions 60 of the bottom arms of the clips are received in the slits 40 with the shoulders 62 firmly engaging the lower rear wall 32 of the cover.

This backsplash assembly assures that the operative assembly is firmly seated against the inside of the cover face without a gap that can accumulate soil. It also assures that the operative assembly mounting will not exhibit unwanted rattles. In addition the assembly is simple and low cost in manufacture; particularly in that the mounting of the operative assembly to the clips also assures firm engagement of the clips with the backsplash cover and eliminates the need for a separate manufacturing step.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. An appliance backsplash assembly, including:

a cover having a face defining an opening therethrough, a top wall projecting generally rearward from the top of said face and a bottom wall projecting generally rearward from the bottom of said face;

a pair of flexible clips, respective ones of said clips positioned behind said face on opposite sides of said opening therein; each clip including a base extending along said face, with a top arm and a bottom arm extending along said top and bottom walls respectively;

an operative assembly including a housing sized and positioned to overlie said opening in said face and to overlap said clips;

a plurality of connectors mounting said operative assembly housing in engagement with said clip bases with said housing abutting said face and with said clips flexed so that said clip bases firmly engage said face and said top and bottom arms firmly engage said top and bottom walls respectively.

2. A backsplash assembly as set forth in claim 1, wherein:

said operative assembly housing and said clips are so sized that, when said housing is placed in engagement with said face around said opening therein, said housing is spaced slightly to the rear of said clip bases and, when said connectors mount said housing in engagement with said bases, said clips have a sufficiently flexed configuration that said bases firmly engage said face and said top and bottom arms firmly engage said top and bottom walls respectively.

3. An appliance backsplash assembly as set forth in claim 1, wherein:

said cover also includes a first rear wall positioned to the rear of said face and a second rear wall positioned to the rear of said face and spaced below said first rear wall, one of said first and second rear walls includes a slit aligned with the position of each of said clips;

the corresponding one of said top and bottom arms of each of said clips includes a distal end portion received in the corresponding one of said slits in one of said first and second rear walls and the other of said top and bottom arms includes a generally perpendicularly projecting distal end portion bearing against the other of said first and second rear walls.

4. An appliance backsplash assembly as set forth in claim 1, wherein;

said cover also includes an upper rear wall projecting generally downward from said top wall in spaced relationship with said face and said top arm of each of said clips includes a generally downwardly projecting distal end portion bearing against said upper rear wall.

5. An appliance backsplash assembly as set forth in claim 4, wherein: said cover further includes an upper ledge projecting inward from the distal edge of said upper rear wall, said upper ledge includes a cutout aligned with the position of each of said clips and sufficiently wide to permit the corresponding clip upper arm to pass through said cutout when said clip in mounted adjacent said cover.

6. An appliance backsplash assembly as set forth in claim 1 wherein: said cover also includes a lower rear wall projecting generally upward from said bottom wall in spaced relationship with said face, said lower rear wall defines a slit aligned with the position of each of said clips; and said bottom arm of each of said clips includes a distal end portion received in a corresponding slit in said lower rear wall.

7. An appliance backsplash assembly as set forth in claim 6, wherein: said cover further includes a lower ledge projecting outward from the distal edge of said lower rear wall and said distal end portion of each clip bottom arm overlaps said lower ledge.

* * * * *